US006015278A

United States Patent [19]

Key et al.

[11] Patent Number: 6,015,278

[45] Date of Patent: Jan. 18, 2000

[54] VANE MACHINE, HAVING A CONTROLLED PRESSURE ACTING ON THE VANE ENDS

[75] Inventors: Al Key, Kenesha; Gregory Lemke, Union Grove; Charles W. Meinke, Burlington; Ronald J. Schilling, Waterford, all of Wis.

[73] Assignee: Robert Bosch GmbH, Stuttgart, Germany

[21] Appl. No.: 08/910,965

[22] Filed: Aug. 7, 1997

[30] Foreign Application Priority Data

Aug. 8, 1996 [DE] Germany ..... 196 31 974

[51] Int. Cl.[7] ..... F01C 1/344; F01C 21/16

[52] U.S. Cl. ..... 418/82; 418/268

[58] Field of Search ..... 418/82, 268

[56] References Cited

U.S. PATENT DOCUMENTS

| | | | |
|---|---|---|---|
| 2,641,195 | 6/1953 | Ferris | 418/82 |
| 3,516,768 | 6/1970 | Bolz et al. | 418/82 |
| 4,722,652 | 2/1988 | Jingin et al. | 418/268 |

FOREIGN PATENT DOCUMENTS

| | | | |
|---|---|---|---|
| 1 728 268 | 3/1972 | Germany . | |
| 1302480 | 1/1973 | Germany . | |
| 2324002 | 1/1980 | Germany . | |
| 2132465C2 | 5/1984 | Germany . | |
| 3446603A1 | 7/1985 | Germany . | |
| 2 96 13 700 | 8/1996 | Germany . | |
| 6207581 | 7/1994 | Japan | 418/268 |

*Primary Examiner*—John J. Vrablik
*Attorney, Agent, or Firm*—Michael J. Striker

[57] ABSTRACT

In the vane machine of the invention the wear-causing pressure differences at the opposite ends (16,18) of the vanes (15) are at least partially reduced, especially during the reversing stages of the vanes (15). A compression gate valve (35) without a valve spring integrated in the vane machine is provided for this. It provides a constant pressure ratio of the pressure with which a vane is pressed against the lift ring during a reversing stage to the system pressure. By controlling the pressure ratio in this way an undue amount of friction of the vanes (15) on the lift ring (20) is avoided, also at high system pressure.

11 Claims, 3 Drawing Sheets

VANE MACHINE, HAVING A CONTROLLED PRESSURE ACTING ON THE VANE ENDS

The present application discloses subject matter also present in the co-pending U.S. patent application, entitled "Pressure Proportioning Regulator" Ser. No. 08/906,563, Aug. 5, 1997, and which is based on German Patent Application 2 96 13 700.6 of Aug. 8, 1996.

BACKGROUND OF THE INVENTION

The present invention relates to a vane machine, especially a vane pump or vane motor, including a housing and a mechanism located in a recess or compartment in the housing, wherein the mechanism comprises a rotatable rotor provided with a plurality of radial slots distributed around its circumference, a plurality of vanes each having a first end and a second end opposite the first end and being guided movably in one of the radial slots to form a compression chamber in that radial slot bounded by walls of that radial slot. The first end of the vanes is located inside that radial slot and the second end is located outside the radial slot and bears on a mechanism wall which moves the vane in the slot during a revolution of the rotor to simultaneously force a volume change in the compression chamber and at least one first compensation duct is provided for a pressurized medium supplied to the compression chambers so that a pressurized medium flows from an inlet connector to an outlet connector of the vane machine.

This type of vane machine is already generally known and it is recognized that the vanes can be prevented from lifting off the vane-motion-producing wall by applying system pressure to the interior ends of the vanes.

The application of the system pressure to the vanes has the disadvantage that the effective hydraulic force on the vanes is limited to the maximum possible system pressure for the vane machine. Comparatively high system pressure produces friction between the outer edges of the vanes and the wall acting to move the vanes in their radial slots, which exceeds the load limit for the materials of both components. Wear and thus a shortening of the lifetime of the vane machine results.

In the vane machine disclosed in German Patent Application DE-OS 1 728 268 the pressure on the vanes is lowered to a constant intermediate pressure by means of a pressure regulator, as soon as the vanes enter their suction or vacuum stage. The pressure regulator, which has a gate valve cooperating with a valve spring so as to react comparatively slowly to changes in the pressure conditions, is integrated in the housing of the vane machine. Its operating conditions are thereby extended to higher system pressures. Generally the intermediate pressure is adjusted for only one operating point of the vane machine. This operating point may wander or vary only slightly before disadvantageous friction, wear or poor performance result.

SUMMARY OF THE INVENTION

It is an object of the present invention to provide an improved vane machine, especially a pump or motor, which does not have the above-described disadvantages.

According to the invention, the vane machine includes a housing having an inlet connector and an outlet connector and a mechanism accommodated in the housing comprising a rotatably mounted rotor provided with a plurality of circumferentially distributed radial slots defined by rotor walls; a plurality of vanes each having a first end and a second end opposite the first end, each vane being guided movably in one of the radial slots with the first end thereof inside the slot to form a compression chamber therein bounded by the rotor walls, and the second ends of the vanes are located outside the radial slots; a lift ring having an inner circumferential portion provided with a mechanism wall and mounted eccentrically in the housing around the rotor so as to have an eccentricity relative to the rotor, the mechanism wall of the lift ring cooperating with the second ends of the vanes to move each vane through a compression stage, a vacuum stage, a first reversing stage and a second reversing stage during a rotor revolution to simultaneously force a volume change in each compression chamber; means for facilitating radial motion of the vanes in the radial slots as soon as each vane passes through a first reversing stage and a second reversing stage including at least one beveled edge provided on the second end of each vane to facilitate the radial motion of the vanes during the first reversing stage and means for controlling and adjusting a compression chamber pressure of a pressurized medium provided in the compression chamber and acting on a first end of each vane to an intermediate pressure depending on a system pressure when that vane passes through a second reversing stage, so as to maintain a constant pressure ratio of intermediate to system pressure. The means for controlling and adjusting a compression chamber pressure to the intermediate pressure includes a gate valve for controlling pressurized medium flow to maintain the constant pressure ratio.

The invention is accordingly based on the knowledge that wear occurring between the outer vane ends and the wall on which they bear is derived from pressure differences Ad which occur between both ends of the vanes, especially during their reversal stages. In contrast during these reversal stages no hydraulic forces act on the outer vane ends. The inner ends of the vanes are acted on with comparatively high pressures in order to guarantee a contact of the vane on the vane-motion-producing wall.

The vane machine, pump or motor, according to the invention is formed so that this type of pressure difference is reduced, i.e. the pressures on the vanes are continuously balanced.

This, among other things, is accomplished by a gate valve integrated in the housing of the vane machine. This lowers the pressure on the inner ends of the vanes for short time during the reversing stages to a value depending on the momentary system pressure of the vane machine.

The ratio between the system pressure and the lower intermediate pressure is maintained constant because of the area ratio at the gate valve and is determined in a series of experiments. It guarantees a contact of the vanes on the vane-motion-producing mechanism wall over a wide operating range. Without this feature wear and/or sealing problems occur at the outer vane ends an/or on the vane-motion-producing mechanism wall.

Fluctuations in the operating conditions are rapidly controlled by the gate valve controlling the pressure ratio. Because of that the vane machine can be operated in an abnormally high pressure range.

The pressure balancing is guaranteed in the vacuum stage and/or pressure stage of the vanes because the housing-side pressurized cavities coupled with the outer vane ends and the rotor-side pressurized cavities are connected with each other by connecting ducts.

Balancing of pressures on the opposite vane ends results from comparatively simple and economical modifications of components present in the known vane machine. The operation of these features is independent of the viscosity of the pressurized medium, requires no adjustment and is not influenced by the appearance of fatigue or wear.

In preferred embodiments of the invention the intermediate pressure is lower than the system pressure and the pressure ratio of the intermediate pressure to the system pressure is from 0.6 to 0.8, advantageously 0.7. The gate valve advantageously operates without a valve-spring and has effective pressing surfaces which are dimensioned in accordance with the pressure ratio of the intermediate pressure to the system pressure.

In other preferred embodiments three compensation ducts are provided in a cover which is part of the housing. Connecting ducts are provided in the housing connecting the compensation ducts with at least one of the connectors and two of them are connected with each other so that pressures on the opposite ends of the vanes are balanced when the vanes pass through a vacuum stage and/or a compression stage by action of the mechanism wall.

Furthermore the mechanism can be provided with a plurality of radially extending cavities for controlling a connection between the first and second ends of the vanes so that forces acting on each vane are balanced when that vane is passed through a vacuum stage and/or a compression stage by action of the mechanism wall.

In additional embodiments of the invention the second ends of the vanes are beveled from one side to the other. The vanes have rounded edges on their second ends and are inclined or tapered in a travel direction of the vanes.

Also a vane machine is conceivable in which the gate valve acts on the inner vane ends only in one of its reversing stages. In the second reversing stage the entire system pressure acts on the inner vane ends. This provides an additional simplification of the vane machine structure. In the second reversing stage the pressure balancing on the vane ends can be the result of a special vane geometry of the outer vane ends.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
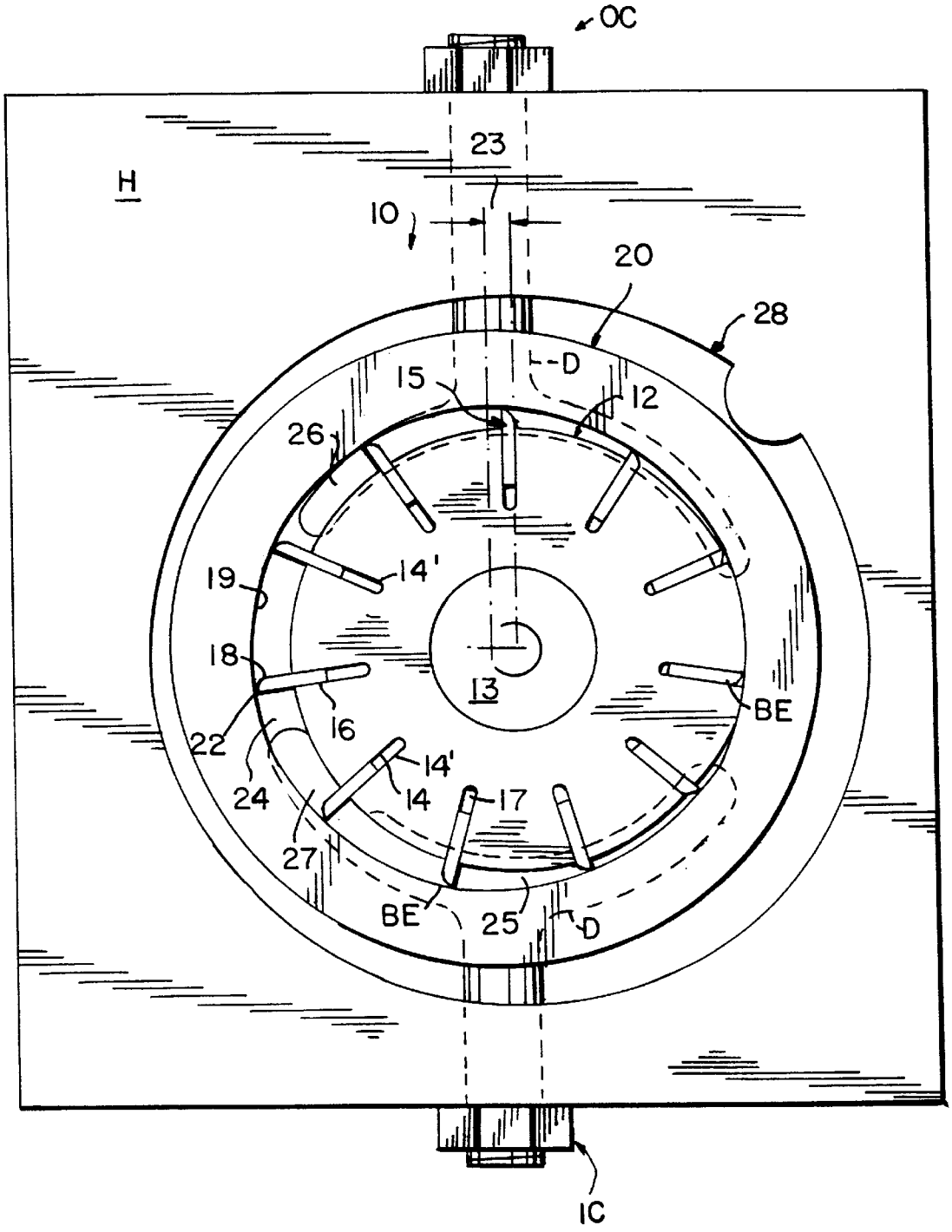
FIG. 1 is a diagrammatic front view of the mechanism of a vane machine according to the invention in which the housing which surrounds the mechanism with the exception of a housing cover has been omitted for simplicity.

FIG. 1 shows a mechanism 10 of a vane machine which is built into a recess in a machine housing H, which is not shown except for its cover, in a manner which is generally known. The mechanism 10 has a rotor 12, which is nonrotatably mounted on a torque transmitting shaft 13 and rotates together with it in a clockwise direction. The rotor 12 has radial slots 14 arranged around its circumference spaced at equal angular intervals from each other, in which the vanes 15 are located. The compression chambers 17 in the rotor 12 are bounded by the rotor walls 14' defining the radial slots 14 and the first ends 16 of the vanes 15 which are inside the rotor 12. The second ends 18 of the vanes 15 opposite to the first ends and projecting from the radial slots 14 brace themselves on an interior mechanism wall 19 of a lift ring 20, which embraces or surrounds the outer circumference of the rotor 12. These second ends 18 have a front surface facing in the direction of rotation of the rotor 12 and thus contact on the lift ring 20 along small sealing contact lines 22. The lift ring 20 is axially slidable relative to the rotor 12 so that an eccentricity 23 is continuously adjustable between it and the rotor 12. The sickle-shaped gap 24 arising because of this eccentricity 23 between the rotor 12 and the lift ring 20 is subdivided into individual working chambers 25 by the vanes 15 of the rotor 12. In the course of a rotation of the rotor 12 these working chambers 25 experience, because of a lifting motion, a volume change which is forced on the vanes 15 by the eccentrically mounted lift ring 20. This volume change produces an under-pressure or an over-pressure in the working chambers, by means of which a pressurized medium flows from an unshown inlet to an outlet connector of the vane machine. The inlet connector IC and outlet connector OC are connected with the working chambers 25 between the vanes 15 by means of pressurized medium connection ducts D, which is, open into reniform flow grooves 26,27. The flow grooves 26,27 are formed on an interior side portion of a cover 28 facing the rotor 12. The cover 28 of the housing closes the working chambers 25 and the front side of the housing recess. The flow grooves extend independently of each other in their longitudinal direction along a common circular path around the central axis of the rotor 12. The radius of this circular path thus conforms to the position of the gap 24 between the lift ring 20 and the rotor 12. Both flow grooves 26,27 extend over a distance of about four working chambers in their longitudinal direction.

Figure 2:
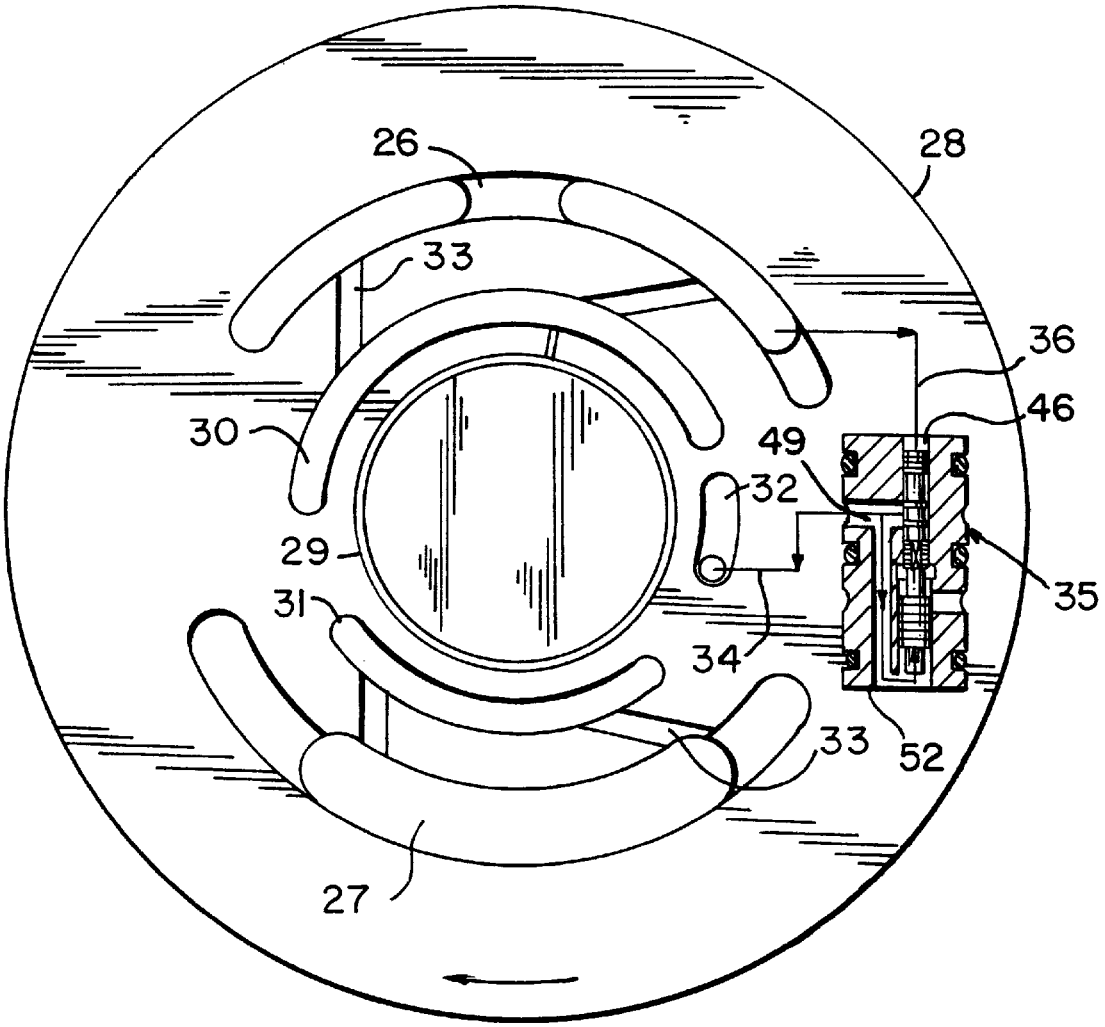
FIG. 2 is a diagrammatic view of the vane machine shown in FIG. 1 showing the circulation of hydraulic medium.

As FIG. 2 shows three compensation grooves 30,31,32 are formed in the inner surface of the cover 28 facing the rotor 12 adjacent both flow grooves 26,27. These compensation grooves 30,31,32 are spaced from each other and extend along a common circular arc. This circular arc is concentric to the circular arc passing through the flow grooves 26,27. The radius of the circular arc on which the compensation grooves 30,31,32 lie is smaller than that of the circular arc on which the flow grooves 26,27 lie and is selected so that the compensation grooves 30,31,32 can cooperate with the compression chambers 17 of the rotor 12.

The dimensions of the flow grooves 26,27 and the compensation grooves 30,31,32 and their position relative to each other is determined by the direction in which the lift ring 20 is shiftable relative to the rotor 12 and by the rotation direction of the rotor 12. A revolution of the rotor 12 divides itself into a vacuum stage, a compression stage and two intervening reversing stages for the vanes 15. Different mechanical and hydraulic forces are applied to the vanes according to these various stages. The arrangement and structure of the flow grooves 26,27 and/or the compensation grooves 30,31,32 is designed to obtain a balancing of the forces on the vanes 15 during rotation of the rotor 12. Because of that, an expansion of the operating range of the vane machine to higher system pressures is possible.

In the vacuum or suction stage, in which vanes 15 are located first at their interior radial turning points and then move from there in the direction of their outer radial turning points, the flow groove 27 is coupled with the vacuum or suction—side connector of the vane machine. Because the lift ring 20 is eccentrically mounted relative to the rotor 12, when the rotor 12 rotates each vane 15 moves radially in its radial slot 14 from an interior radial turning point shown on the right hand side of FIG. 1 to an outer radial turning point shown approximately on the left hand side of FIG. 1. This flow groove 27 begins about 30 degrees after the inner turning points of the vanes 15 and ends about 20 degrees before their outer turning points.

The compensation groove 31 is connected with the flow groove 27 by means of connecting ducts 33. Because of that, a common vacuum-side pressure is present in the flow duct 27 and in the compensation groove 31. The compensation groove 31 begins in the rotation direction of the rotor at about 15 degrees after the start of the flow groove 27 and ends about 15 degrees before the end of the flow groove 27.

In the intervening reversing stage following the vacuum or suction stage the vanes 15 pass over the flow groove 27 and the compensation groove 31 coupled with it and move further in the direction of their outer turning points.

The subsequent compression stage begins when this outer turning point is exceeded. The compression chambers 17 of the rotor 12 are first connected with the compensation groove 30, in which the higher pressure on the compression-side connector of the vane machine is present. Because of that the vanes 15 are brought into contact with the lift ring 20.

Because of the eccentricity between the lift ring 20 and the rotor 12 the vanes move further in the direction of their inner turning points. The flow groove 26 is thus effectively connected with the pressurized connector of the vane machine. The flow groove 26 begins about 30 degrees after the compensation groove 30 in the direction of the rotor 12. The end of the flow groove 26 and the end of the compensation groove 30 are located at the same position in the rotation direction, about 15 degrees in front of the inner turning points of the vanes 15. A closed circular groove 29 is connected with the compensation groove 30. The high pressure in this circular groove 29 presses the rotor 12 against the machine housing H and seals the working chambers 25 because of that. The circular groove 29 is concentric to the compensation grooves 30, 31, 32 and has a smaller radius than those grooves.

The compression stage adjoins a second reversing stage for the vanes 15. In this second reversing stage the outer ends 18 of the vanes 15 pass over the end of the flow groove 26 and/or that of the compensation groove 30 and are located just in front of their inner turning points. Now the compensation groove 32 is in operation. It is connected to the compensation groove 30 with a comparatively small spacing in the rotation direction of the rotor 12 and is supplied with pressurized medium from a slider valve 35 via a schematically illustrated connecting line 34. The slider valve 35, which is designed for control of the pressure level in the compensation groove 32, is connected by a simplified connecting line 36 with the flow groove 26.

Figure 3:
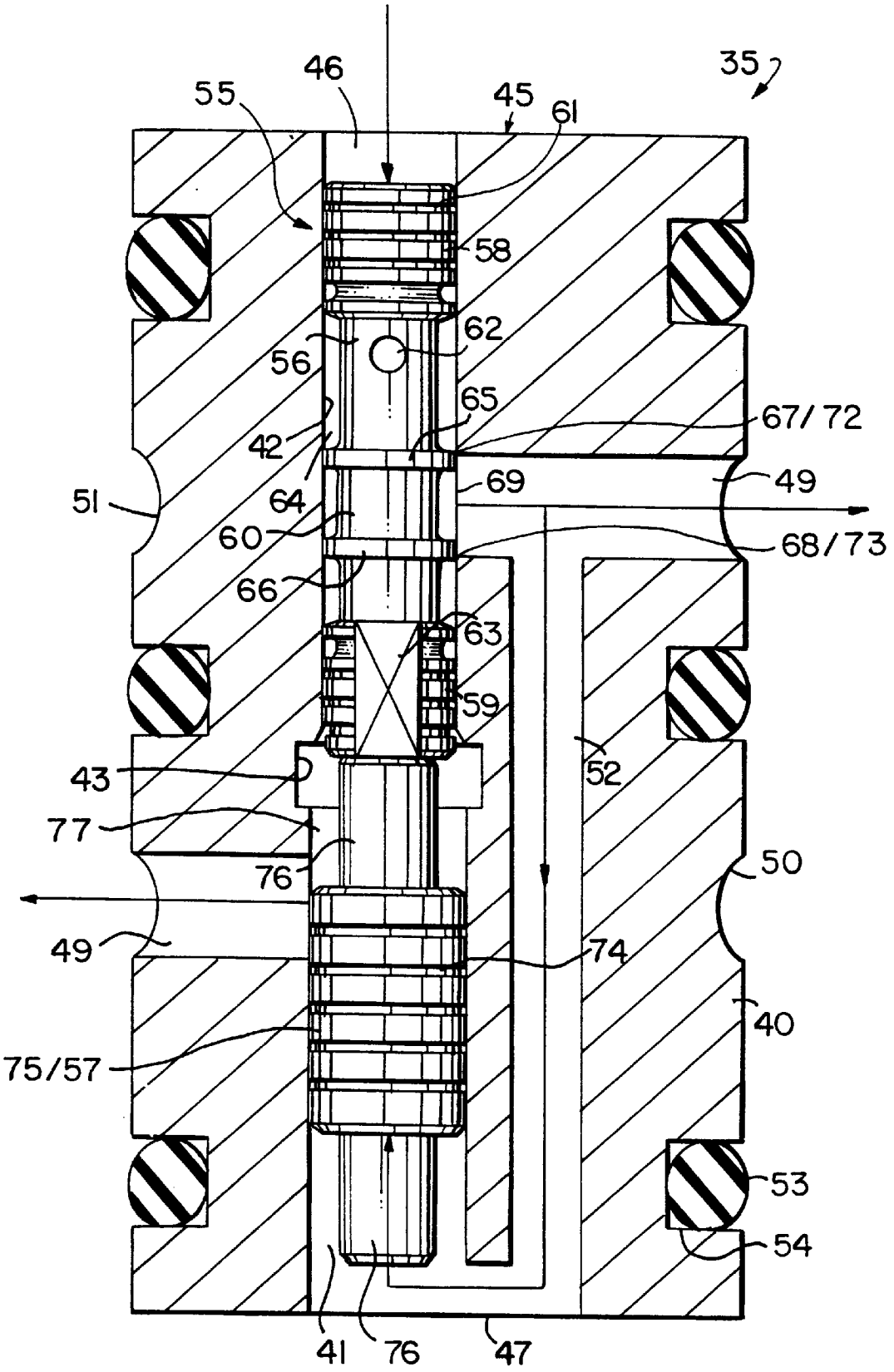
FIG. 3 is a longitudinal cross-sectional view of a slide valve from the pumping apparatus shown in FIG. 2 as a separate part and in the neutral position.

The slider valve 35 shown in detail in FIG. 3 has a cylindrical valve housing 40 with a throughgoing passage 41 arranged eccentrically in the valve housing 40. The throughgoing passage 41 extends parallel to the longitudinal axis of the slider valve 10 and consists of three sections 42, 43 and 44 with different internal diameters. The beginning section 42 at the first end of the valve housing 40 has the smallest inner diameter and forms the inlet 46 for the slider valve 10. The beginning section 42 connects with a short central section 43 which has the largest inner diameter of the three sections and which continues into the final section 44. This final section 44 extends to the second end 47 of the slider valve 35 and has an inner diameter which is between that of beginning section 42 and that of the central section 43.

Circular channels are provided in the outer circumferential surface of the valve housing 40, which are connected by means of the radial passages 49 with the throughgoing passage 41. These circular channels form feedback duct 50 and/or control duct 51 for the slider valve 35. The feedback duct 50 and the control duct 51 are arranged in different planes extending at right angles to the throughgoing passage 41. The plane which passes through the control duct 51 also passes through the beginning section 42 of the throughgoing passage 41, while the plane which passes through the feedback duct 50 also passes through the final section 44 of the throughgoing passage 41. The control duct 51 is connected with the throughgoing passage 41 by a longitudinal duct 52 extending parallel to the throughgoing passage 41 at the foot-end 47 of the slider valve 35.

The feedback duct 50 and the control duct 51 are sealed from the outside by sealing members 53 which are inserted in circumferential sealing grooves 54 in the valve housing.

A gate valve 55 is movably guided in the throughgoing passage 41 to regulate the pressure ratio between the pressure level at the inlet 46 and that in the control duct 51 of the slider valve 35. The gate valve 55 comprises a sliding control member or first gate valve portion 56 and a piston 57. Their outer diameters conform to the diameter of the beginning section 42 and/or the end or final section 44 of the throughgoing passage 41, in which they are guided.

The sliding control member 56 is bone-shaped and has two ends 58,59 widened in their outer diameter and a central region 60 tapered in its outer diameter. Both ends 58,59 act to guide the control member 56 in the throughgoing passage 41 and are equipped with circumferential lubricating grooves 61. Connecting ducts 62 and/or flattened portion on both ends 58,59 of the control member 56 provide an intervening chamber 64 bounded by the wall of the throughgoing passage 41 and the central portion 60 of the first gate valve portion 56. Two collars 65,66 are formed on the central portion 60 of the control member 56 and divide this intervening chamber 64 into individual compartments. The arrangement and spacing of the collars 65,66 with respect to each other is designed to conform to the position and/or the diameter of the control duct 51 opening into this region of the throughgoing passage of the valve housing 40. The outer edges 67,68 of the collar 65,66 facing the end of the first gate valve portion 56 together with the edge 69 which is located at the opening of the radial passage from the control duct 51 into the throughgoing passage 41 form an inlet-side control throttle 72 and a feedback control throttle 73 coupled with it. Both control throttles 72,73 are closed in the neutral position of the gate valve 55.

The piston 57 has a guiding part 75 conforming in its outer diameter to the largest inner diameter of the throughgoing passage 41, which is provided with circumferential lubricating grooves 74 for improving the sliding properties of the piston 57 in the throughgoing passage 41. Connecting elements 76 smaller in their outer diameter than the guiding part 75 are connected on either side in the longitudinal direction to the guiding part 75. The piston 57 is connected by one of the connecting elements 76 on the sliding control member 56 at a connecting position in a plane which extends perpendicularly to the control member in the vicinity of the central section 43 of the throughgoing passage 41. The length of the connecting element 76 and/or the position of the feedback duct 50 of the gate valve 35 are designed so that a passage 77 exists between the central section 43 of the throughgoing passage 41 and the feedback duct 50 in the valve housing 40.

This type of gate valve 35 regulates to provide a constant, i.e. independent of the level of the pressure at the inlet 46, pressure ratio between the pressure at the inlet 46 and the pressure in the control duct 51 in a hydraulic circuit.

The operation of the slider valve according to the invention is described in greater detail in the following. This description assumes that the system pressure supplied thus far from the hydraulic pressure generator has changed in the direction of a higher pressure value.

The increased system pressure acts on a first pressing surface of the gate valve 55 extending outward beyond the inlet 46 of the slider valve 35 and moves it out from its neutral position because of the higher pressure. The inlet-side control throttle 72 closed in the neutral position opens, because of that, so that the pressurized medium can flow through the connecting duct 62 at the outwardly projecting end 58 of the sliding control member 56 into the intervening chamber 64 and from there flows after being throttled, i.e. at lowered pressure, into the control duct 51 and/or to the longitudinal duct 52. Since the longitudinal duct 52 is connected at the foot end 47 of the slider valve 35 with the throughgoing passage 41, the pressure in the longitudinal duct 52 acts on the second outwardly facing pressing surface of the gate valve 55. The pressure differences arising between the first and the second pressuring surfaces of the gate valve 55, because of the area differences due to the different diameters, change the position of the gate valve 55 and thus the cross-section of the inlet-side control throttle 72 until the forces on the gate valve 55 again balance. When the forces balance the gate valve 55 is located again in its neutral position, i.e. the control throttles 72,73 are again closed and the pressure ratio between the pressure at the inlet 46 and the pressure at the control duct 51 is again produced. This pressure ratio is inversely proportional to the ratio between the first and the second pressing surface areas of the gate valve. Although the system pressure and also the control pressure now both have a higher pressure value than before, the ratio between the system pressure and the control pressure remains unchanged.

In case of a reduction of the system pressure produced by the pressure generator, the pressing force on the first pressing surface of the gate valve 55 is correspondingly reduced. The balancing or equilibrium of the forces on the gate valve 55 disturbed by that leads to a position change of the gate valve 55 in the direction of the first end 45 of the valve housing 40. Because of that, the return side control throttle 73 opens. The pressurized medium located in the control duct 51 flows through the control throttle 73 into the chamber between the rear collar 66 and the second end 59 of the first gate valve portion or control member 56 and from there along the flattened portion 63 into the central section 43 of the throughgoing passage 41. From there the pressurized medium arrives along the throughgoing passage 77 between the connecting element 76 of the second gate valve portion 57 and the wall of the throughgoing passage 41 to the feedback duct 50. The pressure in the control duct 51 and, because of that, also in the longitudinal duct 52 of the slider valve 35 is reduced by the pressurized medium flowing away. Because of that, the pressuring force on the second pressing surface of the gate valve 55 is reduced. The regulating motion is ended when the forces on the gate valve 55 are in equilibrium. In this condition both control throttles 72,73 are again closed by the collars 65,66 of the first gate valve potion 56. The system pressure as well as the control pressure has a value which is lower than its previous value, however the ratio between the pressures remains constant.

Using this type of slider valve 35 in the vane machine according to the invention the above-described regulating behavior produces a control pressure in the compensation groove 32 of the vane machine, whose value depends on that of the system pressure, but at the same time stays in a fixed ratio to the system pressure. This ratio takes a value between 0.6 and 0.8, advantageously 0.7, based on the area ratios in the gate valve 55. In this embodiment the control pressure is about 30% less than the system pressure.

The basis for this design results from observation of the force ratio on the vanes 15 of the prior art vane machine, as it is at the time of reversal of the vanes 15 from the reversing stage to their pressure stage, and vice versa.

The transition from the reversing stage into the compression stage is described next.

In this state the inner ends 16 of the vanes 15 are already acted on with system pressure in order to guarantee that they are applied to the lift ring 20. The front sides of the vanes 15, i.e. the sides leading in the rotation direction of the rotor, are acted on with the prevailing pressure there at the entrance in the flow groove 26, while still no pressure acts on their following or tailing sides. The vanes 15 then experience a tilting motion opposite to the direction of rotation of the rotor, because of the forces pressing them into their radial slots 14. The frictional forces on the vanes 15 originating from this titling motion hinder their inward motion forced by the eccentricity 23 of the lift ring 20, or stops it completely in the extreme case. A wear mark arises on the lift ring 20 which extends itself until also the rear side of the vanes 15 are under the system pressure. The vanes 15 are now centered in their radial slots 14 free of transverse forces.

In transition from the high pressure in the reversing stage no pressure is present on the front sides of the vanes 15 leading in the rotation direction of the rotor 12 in the vicinity of their outer ends 18, while the system pressure still is acting on the rear sides trailing in the rotation direction of the rotor. This leads again to a tilting motion of the vanes 15 in the radial slots 14 of the rotor 12. The tilting motion, which occurs in the rotation direction of the rotor 12 in this reversing stage, produces friction forces again on both sides of the vanes 15, which opposes the centrifugal force on the vanes due to the rotational motion of the rotor 12 and thus stops their outward motion. In order to guarantee that the outer end 18 of the vane 15 bears on the lift ring 20 the inner ends 16 of the controlling vanes 15 are acted on with the system pressure. Of course the vane machine can be in an operating state in which the system pressure on the inner ends 16 of the vanes 15 has a value such that its pressing force on the lift ring 20 leads to undesirable wear between the structural elements.

Wear on the lift ring 20 can be avoided in at least one of both reversing stages by beveling the outer front surface of the vanes 15. The beveling acts so that the front surface of each of the beveled vanes 15 are under a stabilizing transverse force as soon as that vane 15 enters or leaves the flow groove 26 which is under the system pressure. This transverse force opposes both the force on the inner end of that vane 15 and the tilting force on that vane 15 and thus weakens the action of these forces on the lift ring 20 which are responsible for the wear.

The direction of the beveling on the outer front surface of the vanes 15 determines the reversing stage in which these features act. In the opposing reversing stage, in which the pressure conditions on the sides of the vanes 15 are reversed, this effect cannot build up. The beveling can lead to reinforcement of wear between the lift ring 20 and the vanes 15 in the opposing reversing stage, because the vanes 15 contact only with their smaller contacting surface on the lift ring 20 and correspondingly experience a higher pressure on that surface.

It is thus suggested to reduce the pressure on the inner ends 16 of the vanes 15 relative to the system pressure during this opposing reversing stage. In order to avoid a fluctuating system pressure that would be caused by the relief of the system pressure with differing strengths, the ratio of the control pressure to the system pressure should remain constant. This is provided by the above-described slider valve 35.

Understandably changes or improvements in the described examples are possible without varying from the concept of the invention.

Thus vane machines are conceivable which do not have compensation grooves 30 and 31, which provide pressure equilibration on the vanes 15 in the vacuum or suction stage or the compression stage. This operation of the compensation grooves 30 and 31 is performed in alternative embodiments by recesses, which are formed in the vanes 15 themselves or in the radial slots 14 of the rotor 12 and which connect the flow grooves 26, 27 with the compression chambers 17 so that the pressure on the outer end 18 of the concerned vane 15 is the same as that on its inner end 16.

On transition of a vane 15 from its vacuum or suction stage to its compression stage pressure equalization at its ends 16,18 can also be achieved by forming a second compensation groove 32, which is acted on with a pressure in the control duct 51 which is reduced with respect to the system pressure. In this embodiment the compensation groove 30 acting on the current system pressure must be shortened appropriately, but the beveling of the outer front surfaces of the vanes could however be eliminated.

The disclosure in German Patent Application 196 31 974.9-42 of Aug. 8, 1996 is incorporated here by reference. The invention described hereinabove and claimed in the claims appended hereinbelow is also described in this German Patent application which forms the basis for a claim of priority under 35 U.S.C. 119.

While the invention has been illustrated and described as embodied in a vane machine, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

We claim:

1. A vane machine comprising a housing (H) provided with an inlet connector (IC) and an outlet connector (OC) and a mechanism (10) accommodated in the housing; said mechanism (10) comprising a rotatably mounted rotor (12) provided with a plurality of circumferentially distributed radial slots (14) defined by rotor walls (14') of the rotor, a plurality of vanes (15) each having a first end (16) and a second end (18) opposite the first end, each of said vanes (15) being guided movably in one of the radial slots (14) with the first end thereof inside said radial slot to form a compression chamber (17) therein bounded by said rotor walls, and the second ends (18) of said vanes are located outside the radial slots, a lift ring (20) having an inner circumferential portion provided with a mechanism wall (19) and mounted eccentrically in said housing around said rotor (12) so as to have an eccentricity (23) relative to said rotor, said mechanism wall (19) of the lift ring (20) cooperating with said second ends (18) of the vanes to move each of the vanes in the radial slots through a compression stage, a vacuum stage, a first reversing stage and a second reversing stage during a revolution of the rotor (12) to simultaneously force a volume change in each of the compression chambers (17), and means for facilitating radial motion of the vanes in the radial slots (14) as soon as each of said vanes (15) passes through said first reversing stage and said second reversing stage, said means for facilitating the radial motion of the vanes including at least one beveled edge (BE) provided on the second end (18) of each of the vanes to facilitate the radial motion of the vanes during the first reversing stage, and means for controlling and adjusting a compression chamber pressure of a pressurized medium provided in said compression chamber (17) and acting on said first end (16) of each of said vanes (15) to an intermediate pressure depending on a system pressure when said vane passes through said second reversing stage, so as to maintain a constant pressure ratio of said intermediate pressure to said system pressure, said means for controlling and adjusting comprising a gate valve (35) integrated in said housing (H).

2. The vane machine as defined in claim 1, wherein the intermediate pressure is lower than the system pressure and said pressure ratio of the intermediate pressure to the system pressure is from 0.6 to 0.8.

3. The vane machine as defined in claim 2, wherein said pressure ratio is 0.7.

4. The vane machine as defined in claim 1, wherein said gate valve (35) operates without a valve spring, and said gate valve (35) has effective pressing surfaces dimensioned according to said pressure ratio of the intermediate pressure to the system pressure.

5. The vane machine as defined in claim 1, further comprising means for connecting the inlet connector (IC) and the outlet connector (OC) to provide a flow of said pressurized medium between the inlet connector (IC) and the outlet connector (OC), said means for connecting including at least one housing-side compensation passage comprising compensation ducts (30,31,32), and means for balancing forces on said first end and said second end of each of said vanes when each of said vanes passes through at least one of said vacuum stage and said compression stage, said means for balancing forces comprising said gate valve (35) and said compensation ducts, and wherein two (30,32) of the compensation ducts (30,31,32) are connected with each other via a plurality of connecting ducts (33) and said gate valve (35).

6. The vane machine as defined in claim 1, further comprising means for controlling a connection between the first ends (16) and the second ends (18) of the vanes so that forces acting on each of the vanes are balanced when said vanes are passed through one of said vacuum stage and said compression stage, said means for controlling said connection including a plurality of radially extending cavities provided in the mechanism.

7. The vane machine as defined in claim 1, wherein said at least one beveled edge (BE) on said second end (18) of each of said vanes (15) extends from one side of said vane to another.

8. The vane machine as defined in claim 7, wherein said vanes (15) have rounded edges at said second ends (18) thereof and are inclined in a travel direction of the vanes.

9. The vane machine as define in claim 1, wherein the housing (H) includes a cover (28) and the gate valve (35) is located in the cover (28).

10. The vane machine as defined in claim 1, consisting of a vane pump.

11. The vane machine as defined in claim 1, consisting of a vane motor.

* * * * *